US010121412B2

(12) United States Patent
Choi

(10) Patent No.: US 10,121,412 B2
(45) Date of Patent: Nov. 6, 2018

(54) DISPLAY DEVICE AND TIMING CONTROLLER

(71) Applicant: LG DISPLAY CO., LTD., Seoul (KR)

(72) Inventor: Jinsol Choi, Seoul (KR)

(73) Assignee: LG DISPLAY CO., LTD., Seoul (KR)

( * ) Notice: Subject to any disclaimer, the term of this patent is extended or adjusted under 35 U.S.C. 154(b) by 104 days.

(21) Appl. No.: 14/835,125

(22) Filed: Aug. 25, 2015

(65) Prior Publication Data

US 2016/0063918 A1 Mar. 3, 2016

(30) Foreign Application Priority Data

Sep. 3, 2014 (KR) ..... 10-2014-0117039

(51) Int. Cl.
*G09G 3/32* (2016.01)
*G09G 3/36* (2006.01)
*G09G 3/3233* (2016.01)

(52) U.S. Cl.
CPC ..... *G09G 3/3233* (2013.01); *G09G 2320/043* (2013.01); *G09G 2330/08* (2013.01)

(58) Field of Classification Search
CPC ..... G09G 3/32; G09G 3/3223; G09G 3/3225; G09G 5/00; H04N 5/202; H03M 1/06; H03M 1/0602; G06F 11/0751; G06F 11/0763; G06F 11/0766; G06F 11/0769; G06F 11/0772
See application file for complete search history.

(56) References Cited

U.S. PATENT DOCUMENTS 9,478,171 B2 * 10/2016 Song ..... G09G 3/3266
2009/0040389 A1 * 2/2009 Wang ..... H04N 5/202 348/674
2011/0304489 A1 * 12/2011 Christer ..... H03M 1/1019 341/118
2012/0139882 A1 * 6/2012 Kim ..... G09G 5/008 345/204
2013/0021306 A1 * 1/2013 Kuo ..... G09G 3/20 345/204
2013/0050176 A1 * 2/2013 Kim ..... G09G 3/36 345/214
2014/0068374 A1 * 3/2014 Ha ..... H03M 13/2909 714/755
2014/0313065 A1 * 10/2014 Schafferer ..... H03M 1/06 341/118
2014/0354618 A1 * 12/2014 Shin ..... G09G 3/3225 345/212
2015/0026506 A1 * 1/2015 Lee ..... G06F 11/0706 714/3

FOREIGN PATENT DOCUMENTS

CN 1975523 A 6/2007
CN 101071212 A 11/2007
CN 102956212 A 3/2013

* cited by examiner

*Primary Examiner* — Jennifer Mehmood
*Assistant Examiner* — Sardis F Azongha
(74) *Attorney, Agent, or Firm* — Dentons US LLP

(57) ABSTRACT

Disclosed is a display device and a timing controller that can check the status of a display driving related unit, take a proper countermeasure according to the check result, and prevent an abnormal operation of the display driving related unit or prevent a failure in driving, damage to a device, and screen abnormality that may happen according to the abnormal operation of the display driving related unit.

15 Claims, 8 Drawing Sheets

FIG. 8

220c

| CHANNEL | CH1 | CH2 | CH3 | CH4 | CH5 | CH6 | CH7 | CH8 |
|---|---|---|---|---|---|---|---|---|
| STATUS BIT | 0 | 0 | 0 | 0 | 0 | 0 | 0 | 1 |

220c

| CHANNEL | CH1 | CH2 | CH3 | CH4 | CH5 | CH6 | CH7 | CH8 |
|---|---|---|---|---|---|---|---|---|
| STATUS BIT | 1 | 0 | 0 | 0 | 1 | 0 | 0 | 0 |

220c

| CHANNEL | CH1 | CH2 | CH3 | CH4 | CH5 | CH6 | CH7 | CH8 |
|---|---|---|---|---|---|---|---|---|
| STATUS BIT | 1 | 0 | 0 | 0 | 1 | 0 | 0 | 0 |

220c

| CHANNEL | CH1 | CH2 | CH3 | CH4 | CH5 | CH6 | CH7 | CH8 |
|---|---|---|---|---|---|---|---|---|
| STATUS BIT | 1 | 0 | 0 | 0 | 1 | 0 | 0 | 0 |

DISPLAY DEVICE AND TIMING CONTROLLER

CROSS-REFERENCE TO RELATED APPLICATION

This application claims priority from and the benefit under 35 U.S.C. § 119(a) of Korean Patent Application No. 10-2014-0117039, filed on Sep. 3, 2014, which is hereby incorporated by reference for all purposes as if fully set forth herein.

BACKGROUND OF THE INVENTION

Field of the Invention

The present invention relates to a display device and a timing controller.

Description of the Prior Art

With the development of the information society, display devices for displaying images are being increasingly required in various forms, and various types of display devices, such as liquid crystal display (LCD) devices, plasma display devices, and organic light emitting display (OLED) devices, are utilized.

Such display devices include a lot of units relating to display driving. The display driving related units have to perform normal driving operations and output normal signals in order to normally display images.

However, the display driving related units in the display devices are more likely to abnormally operate due to various internal and external factors, such as a failure relating to electronic static discharge (ESD), a failure relating to surface mount technology (SMT), a failure caused by temperature and humidity, a failure caused by pressure, and the like.

Therefore, a technology for checking whether the display driving related units normally operate and output normal signals is required.

However, at the present time, there is no method that can check whether multiple display driving related units included in a display device normally operate and output normal signals.

SUMMARY OF THE INVENTION

An aspect of the present invention is to provide a display device and a timing controller that can check the status of a display driving related unit.

Another aspect of the present invention is to provide a display device and a timing controller that can take a proper countermeasure according to the status of a display driving related unit, thereby preventing an abnormal operation of the unit, or preventing a failure in driving, damage to a device, and screen abnormality that may happen according to the abnormal operation of the unit.

In accordance with one aspect of the present invention, a display device includes: a unit status check unit that outputs a status check command signal to a status check unit corresponding to a display driving related unit, receives a signal, as a feedback signal, which is output from the status check unit to a display panel, a data driver integrated circuit, or a gate driver integrated circuit, according to the status check command signal, and records a status bit value of the status check unit in a status register corresponding to the status check unit based on the feedback signal; and a memory that stores the status register corresponding to the status check unit.

In accordance with another aspect of the present invention, a timing controller includes: a status register that corresponds to each of a plurality of status check units relevant to display driving related units; and a unit status check unit that outputs a status check command signal to each of the plurality of status check units, receives a signal, as a feedback signal, which is output from the corresponding status check unit to a display panel, a data driver integrated circuit, or a gate driver integrated circuit, as a feedback signal according to the status check command signal, and records a status bit value of the corresponding status check unit in a status register corresponding to the corresponding status check unit based on the feedback signal.

In accordance with yet another aspect of the present invention, a display device includes: a timing controller that determines the status of a display driving related unit based on an output signal of the display driving related unit, and records a status bit value in a status register corresponding to the display driving related unit; and a memory that stores the status register corresponding to the display driving related unit.

The embodiments of the present invention described above may provide a display device and a timing controller that can check the status of a display driving related unit.

Further, according to the embodiments of the present invention, a proper countermeasure can be taken according to the status of a display driving related unit, thereby preventing an abnormal operation of the unit, or preventing a failure in driving, damage to a device, and screen abnormality that may happen according to the abnormal operation of the unit.

BRIEF DESCRIPTION OF THE DRAWINGS

The above and other aspects, features, and advantages of the present invention will be more apparent from the following detailed description taken in conjunction with the accompanying drawings, in which:

FIG. 8 is a view illustrating yet another example in which a status bit value is recorded in the status register according to a status check result in the display device according to the embodiments.

DETAILED DESCRIPTION OF THE EXEMPLARY EMBODIMENTS

Figure 1:
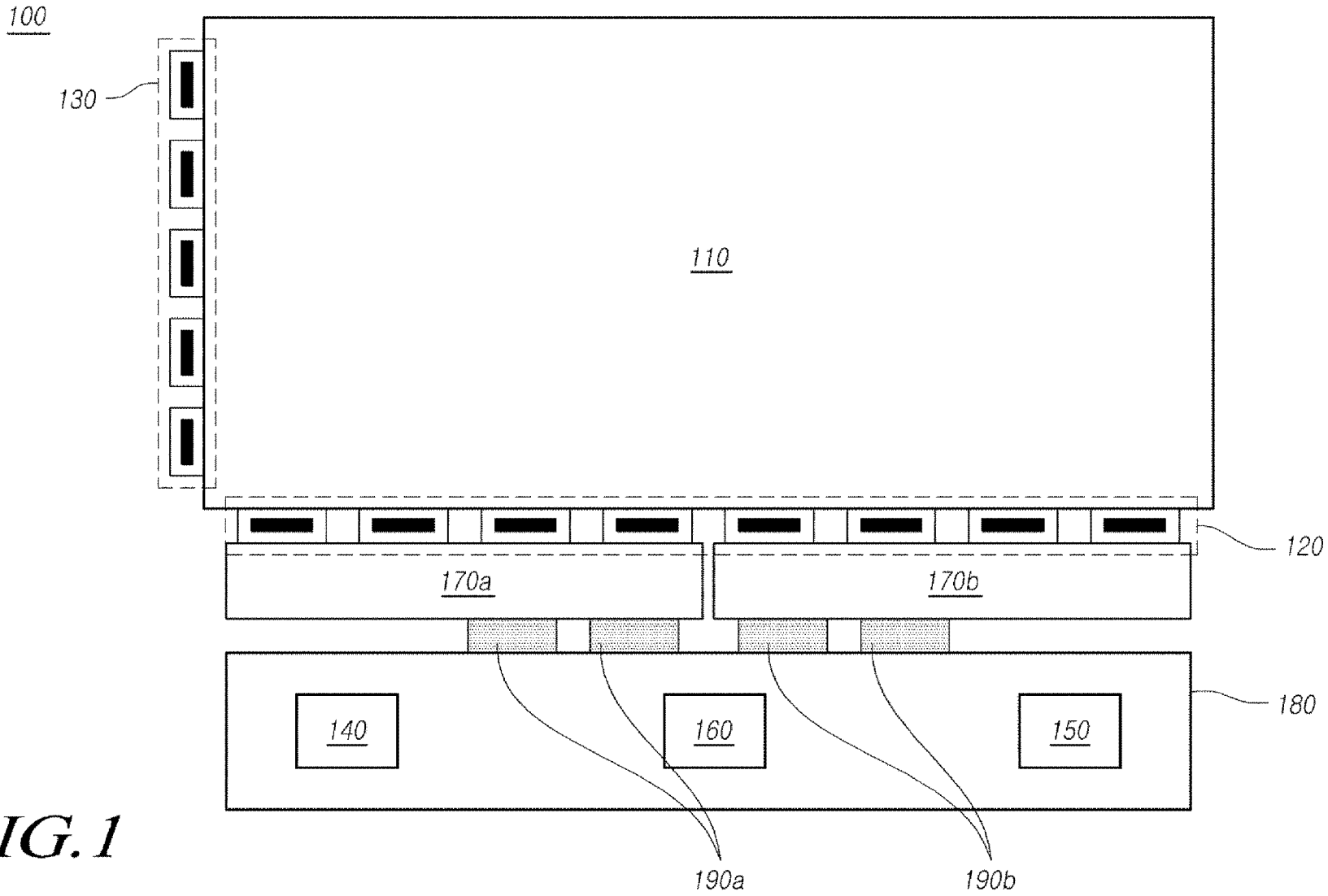
FIG. 1 is a schematic system configuration view of a display device according to embodiments of the present invention.

Hereinafter, some embodiments of the present invention will be described in detail with reference to the accompanying illustrative drawings. In designating elements of the drawings by reference numerals, the same elements will be designated by the same reference numerals although they are shown in different drawings. Further, in the following description of the present invention, a detailed description of known functions and configurations incorporated herein will be omitted when it may make the subject matter of the present invention rather unclear.

In addition, terms, such as first, second, A, B, (a), (b) or the like may be used herein when describing components of the present invention. Each of these terminologies is not used to define an essence, order or sequence of a corresponding component but used merely to distinguish the corresponding component from other component(s). In the case that it is described that a certain structural element "is connected to", "is coupled to", or "is in contact with" another structural element, it should be interpreted that another structural element may "be connected to", "be coupled to", or "be in contact with" the structural elements as well as that the certain structural element is directly connected to or is in direct contact with another structural element.

FIG. 1 is a schematic system configuration view of a display device 100 according to embodiments of the present invention.

Referring to FIG. 1, the display device 100, according to the embodiments, includes a display panel 110 in which m data lines (DL1, . . . , DLm, m: natural number) and n gate lines (GL1, . . . , GLn, n: natural number) are formed, a plurality of data driver ICs 120 for driving the m data lines (DL1, . . . , DLm), a plurality of gate driver ICs 130 for sequentially driving the n gate lines (GL1, . . . , GLn), a timing controller 140 for controlling the plurality of data driver ICs 120 and the plurality of gate driver ICs 130, and the like.

In the display panel 110, pixels are formed at all points where the m data lines (DL1, . . . , DLm) and the n gate lines (GL1, . . . , GLn) intersect each other, respectively.

The timing controller 140 starts a scan according to the timing implemented in each frame, converts image data input through an interface in correspondence to a data signal format used by the plurality of data driver ICs 120 to output the converted image data, and controls data driving at a proper time in correspondence with the scan.

The timing controller 140 may output various types of control signals, such as a data control signal (DCS), a gate control signal (GCS), and the like, in order to control the plurality of data driver ICs 120 and the plurality of gate driver ICs 130.

The plurality of gate driver ICs 130 sequentially provide scan signals of On or Off voltages to the n gate lines (GL1, . . . , GLn) to drive the n gate lines (GL1, . . . , GLn) in a serial order under the control of the timing controller 140.

The plurality of data driver ICs 120, under the control of the timing controller 140, store input image data in a memory (not illustrated), and when a specific gate line is open, the data driver ICs 120 convert the corresponding image data into an analogue form of data voltage (Vdata) to supply the converted data voltage to the m data lines (DL1, . . . , DLm), thereby driving the m data lines (DL1, . . . , DLm).

The plurality of data driver ICs 120 may be connected to bonding pads of the display panel 110 by a tape automated bonding (TAB) method or a chip on glass (COG) method, or may be directly formed on the display panel 110. In some cases, the data driver ICs 120 may also be integrated on the display panel 110. Here, the data driver ICs 120 are also referred to as source driver ICs.

The plurality of gate driver ICs 130 may be positioned only on one side of the display panel 110 as illustrated in FIG. 1, or may be divided into two groups that are positioned on opposite sides of the display panel 110, according to a driving scheme thereof.

Further, the plurality of gate driver ICs 130 may be connected to bonding pads of the display panel 110 by a tape automated bonding (TAB) method or a chip on glass (COG) method, or may be implemented in a gate in panel (GIP) type and directly formed on the display panel 110. In some cases, the gate driver ICs 130 may also be integrated on the display panel 110.

Meanwhile, referring to FIG. 1, the display device 100, according to the embodiments, may further include: a power management integrated circuit (PMIC) 150 that supplies various types of driving power required for driving the display panel 110 to the display panel 110, the plurality of data driver ICs 120, the plurality of gate driver ICs 130, and the timing controller 140; a gamma unit 160 that outputs a gamma voltage to the data driver ICs 120; and the like.

Referring to FIG. 1, each of the plurality of data driver ICs 120 may be implemented in a chip on film (COF) type in which a driver chip is formed on a film, and opposite ends of the data driver IC may be connected to at least one source board 170*a* or 170*b* and a pad (not illustrated) of the display panel 110, respectively. Here, the source board 170*a* or 170*b* is also referred to as a source printed circuit board (S-PCB).

Referring to FIG. 1, the timing controller 140, the power management IC 150, the gamma unit 160, and the like may be mounted on a control board 180. Here, the control board 180 is also referred to as a control printed circuit board (C-PCB).

Referring to FIG. 1, the at least one source board 170*a* or 170*b* and the control board 180 may be connected to each other through a flexible printed circuit (FPC) 190*a* or 190*b*.

The display device 100, which is schematically illustrated in FIG. 1, may be one of a liquid crystal display (LCD) device, a plasma display device, an organic light emitting display (OLED) device, and the like.

Circuit devices, such as a transistor, a capacitor, and the like, are formed on each pixel that is formed in the display panel 110 described above. For example, in cases where the display panel 110 is an organic light emitting display panel, circuit devices, such as an organic light emitting diode, two or more transistors, one or more capacitors, and the like, may be formed on each pixel.

Meanwhile, various types of circuit devices, such as transistors, which are formed on the respective sub-pixels P formed in the display panel 110, have unique characteristic values.

For example, the transistors have unique characteristic values, such as a threshold voltage (Vth), mobility, and the like.

The transistors may have slightly different unique characteristic values. Accordingly, the luminance of the sub-pixels may be different from each other.

Particularly, the transistors may be gradually degraded as the driving time thereof increases, and there may be wide variations in the unique characteristic values of the transistors according to the degree of degradation, which leads to wide variations in luminance between the sub-pixels.

Accordingly, the display device 100, according to the embodiments, may provide a sensing function of detecting the unique characteristic values (e.g., a threshold voltage, mobility, etc.) of the circuit devices, such as the transistors, which are form on the respective sub-pixels, and a compensating function of performing data compensation for changing data to be provided to the respective sub-pixels in order to compensate for the variations in the unique characteristic values of the circuit devices, namely, in order to compensate for the variations in luminance between the sub-pixels, based on the results (sensed data) obtained by detecting the unique characteristic values of the circuit devices.

Meanwhile, the display driving related units, such as the data driver ICs 120, the gate driver ICs 130, the power management IC 150, the gamma unit 160, and the like, have to perform normal driving operations and have to output normal signals in order to display normal images.

Operations of the display driving related units will be described below.

The power management IC 150 supplies a high-level gate voltage (VGH) and a low-level gate voltage (VGL) to the plurality of gate driver ICs 130 in order to enable the gate driver ICs 130 to generate and output scan signals.

In cases where the power management IC 150 abnormally operates, there is an an abnormality in the high-level gate voltage (VGH) and the low-level gate voltage (VGL) which are supplied to the plurality of gate driver ICs 130, so the plurality of gate driver ICs 130 will abnormally operate, thereby causing a failure in driving as well as a screen abnormality.

The gate driver ICs 130 have to be normally supplied with the high-level gate voltage (VGH) and the low-level gate voltage (VGL) and have to output normal scan signals. If the gate driver ICs 130 abnormally operate, the gate driver ICs 130 will fail to normally output the desired scan signals and will thereby cause a screen abnormality.

The data driver ICs 120 have to receive image data from the timing controller 140 and normally output data voltages using digital analog converters (DACs), etc.

In cases where the digital analog converters (DACs) in the data driver ICs 120 fail to normally operate, the data driver ICs 120 may not normally output desired data voltages to thereby cause screen abnormality.

Meanwhile, the transistors in the respective pixels are gradually degraded according to the driving time thereof. That is, the unique characteristic values (e.g., a threshold value, mobility, etc.) of the transistors in the respective pixels vary with the driving time of the transistors. The changes and variations in the unique characteristic values of the transistors may cause variations in luminance between the pixels.

For pixel compensation related to this, analog digital converters (ADCs) corresponding to sensing units that may be implemented in the data driver ICs 120 sense the unique characteristic values of the transistors in the respective pixels and transmit the sensed data to the timing controller 140.

A compensation unit (not illustrated) in the timing controller 140 determines compensation values for compensating for the changes and variations in the unique characteristic values of the transistors based on the received sensed data, and changes image data according to the determined compensation values to transmit the changed image data to the data driver ICs 120.

The data driver ICs 120 convert the changed image data into data voltages (Vdata) of analog signals and output the data voltages to the corresponding data lines. At this time, the digital analog converters (DACs) in the data driver ICs 120 and the gamma unit 160, such as a driving programmable gamma (Driving P-Gamma) unit and a sensing programmable gamma (Sensing P-Gamma) unit, are involved.

Accordingly, the analog digital converters (ADCs) and the digital analog converters (DACs) in the data driver ICs 120, the element, such as the compensation unit, in the timing controller 140, the gamma unit 160, such as the driving programmable gamma (Driving P-Gamma) unit and the sensing programmable gamma (Sensing P-Gamma) unit, and the power management integrated circuit 150 all have to normally operate for the normal compensation operation.

Like this, all the display driving related units in the display device 100 may cause a serious failure in driving and a screen abnormality when failing to normally operate or when failing to output normal signals.

However, the display driving related units in the display device 100 are more likely to abnormally operate due to various internal and external factors, such as a failure relating to electronic static discharge (ESD), a failure relating to surface mount technology (SMT), a failure caused by temperature and humidity, a failure caused by pressure, and the like.

Therefore, a technology for checking whether the display driving related units normally operate and output normal signals is required.

Nevertheless, since the display driving related units basically receive only one-way commands from the timing controller 140 to perform operations according to the instructions, it has been impossible to check the status of the display driving related units which operate according to the one-way commands.

Accordingly, the embodiments of the present invention provide a unit status check function of checking whether the display driving related units abnormally operate, checking in advance a display driving related unit that is more likely to abnormally operate, or identifying a display driving related unit that abnormally operates, provide a proper countermeasure according to the unit status check result, and propose a signal transmitting system for the same.

Hereinafter, the unit status check function and the countermeasure according to the unit status check result will be described in more detail with reference to FIG. 2.

Figure 2:
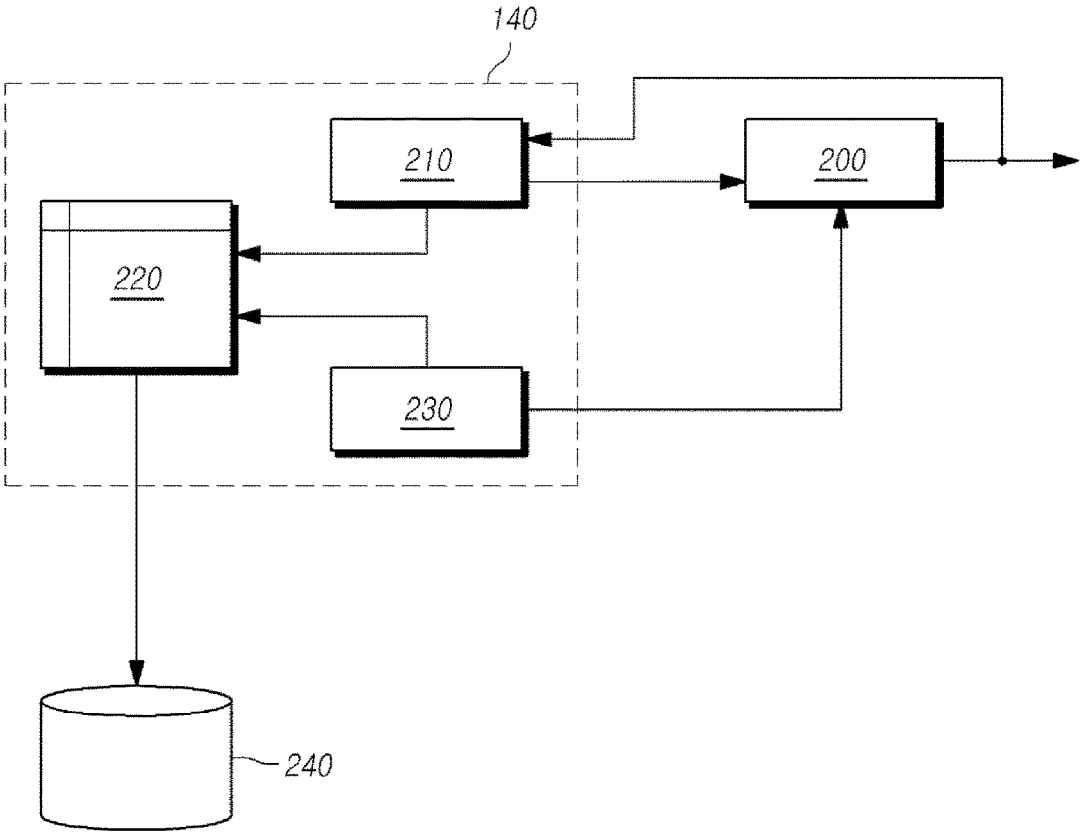
FIG. 2 is a view illustrating a system that provides a unit status check function for the display device according to the embodiments.

FIG. 2 is a view illustrating a system that provides a unit status check function for the display device 100 according to the embodiments.

Referring to FIG. 2, for a unit status check function and a countermeasure according to a unit status check result, the display device 100, according to the embodiments, includes a timing controller 140 and a memory 240. The timing controller 140 outputs a status check command signal to a status check unit 200 for at least one of the data driver ICs 120, the gate driver ICs 130, the power management IC 150, and the gamma unit 160 as display driving related units, receives an output signal, as a feedback signal, which is output from the status check unit 200 according to the status check command signal, and records the status bit value of the status check unit 200 in a status register 220 corresponding to the status check unit 200 based on the feedback signal, and the memory 240 stores the status register 220 corresponding to the status check unit 200.

Here, the status check command signal may be, for example, a signal for triggering an operation of the status check unit 200 in order to check the status of the status check unit 200, or a signal necessary for an operation of the status check unit 200, and may vary with the type of the status check unit 200. For example, the status check command signal may be an enable signal, command data, image data, data corresponding to a voltage, etc.

As described above, the timing controller 140 may receive an output signal, as a feedback signal, from each display driving related unit, namely, the status check unit 200, may determine the status of the status check unit 200 based on the feedback signal, and may record the status bit value according to the determination result in the corresponding status register 220, thereby identifying the status of the display driving related unit.

Referring to FIG. 2, the timing controller 140 includes the status register 220 that corresponds to each of the plurality of status check units 200 corresponding to display driving related units, and a unit status check unit 210 that outputs a status check command signal to each of the plurality of status check units 200, receives a signal, as a feedback signal, which is output from the corresponding status check unit 200 to the display panel 110, the data driver ICs 120, or the gate driver ICs 130 according to the status check command signal, and records the status bit value of the corresponding status check unit 200 in the status register 220 corresponding to the corresponding status check unit 200 based on the feedback signal.

By using the timing controller 140 described above, it is possible to check the status of each display driving related unit, namely, the status check unit 200, record the status bit value according to the check result in the corresponding status register 220, and then identify the status of the display driving related unit.

Meanwhile, the timing controller 140, according to the embodiments, may further include a controller 230 that controls the status check unit 200, the display device 100, or power according to the status bit value recorded in the status register 220 corresponding to the status check unit 220.

The above-described controller 230 of the timing controller 140 may perform a proper control according to the status check result of the status check unit 200 in order to prevent an abnormal operation of the status check unit 200, or to prevent various problems (e.g., screen abnormality, panel burnt, etc.) that may be caused by the abnormal operation of the status check unit 200.

Meanwhile, although the unit status check unit 210, the status register 220, and the controller 230 is illustrated in FIG. 2 to be included in the timing controller 140, this is only illustrative for the convenience of description, and in some cases, all or some of the unit status check unit 210, the status register 220, and the controller 230 may also be implemented as external elements of the timing controller 140.

The unit status check unit 210 described above determines whether an actual output value identified from the feedback signal from the corresponding status check unit 200 falls within a predetermined normal output range. When it is determined that the actual output value falls within the predetermined normal output range, the unit status check unit 210 determines that the status check unit 200 is in a normal status, and records a normal status bit value (e.g., 0) in the status register 220. In contrast, when it is determined that the actual output value departs from the predetermined normal output range, the unit status check unit 210 determines that the status check unit 200 is in an abnormal status, and records an abnormal status bit value (e.g., 1) in the status register 220.

Here, the normal output range may particularly be a demand value that is desired to be output from the status check unit 200, or a range that has predetermined upper and lower margins, which correspond to a design value, with respect to the demand value. The normal output range is information already known to the unit status check unit 210.

When determining whether the status check unit 200 is in a normal or abnormal status, the unit status check unit 210 may make the determination in consideration of the normal output range rather than a specific value, thereby adjusting the degree of severity of the determination by varying the normal output range, and reducing a possibility of misjudging a normal status to be an abnormal status.

Meanwhile, even if it is determined that the corresponding status check unit 200 is in an abnormal status, since the abnormal status may be a temporarily abnormal status that can be recovered to a normal status, it may be problematic to finally confirm the determination on the abnormal status at a time. Further, even if it is determined that the corresponding status check unit 200 is in a normal status, since the normal status may be a temporarily normal status that may be changed to an abnormal status, it may be problematic to finally confirm the determination on the normal status at one time.

Accordingly, although the unit status check unit 210 may finally confirm the status of the corresponding status check unit 200 to be normal or abnormal when a normal status bit value or an abnormal status bit value is recorded once, the unit status check unit 210 may finally confirm the status of the corresponding status check unit 200 through several checks in consideration of the possibility of a temporary abnormality or a temporary normality.

Accordingly, when a normal status bit value (e.g., 0) is continually recorded in the status register 220 of the corresponding status check unit 200 more than "the number of times (e.g., three times) for confirming a normal status," the unit status check unit 210 finally confirms that the corresponding status check unit 200 is in a normal status.

Further, when an abnormal status bit value (e.g., 1) is continually recorded in the status register 220 of the corresponding status check unit 200 more than "the number of times (e.g., three times) for confirming an abnormal status," the unit status check unit 210 finally confirms that the corresponding status check unit 200 is in an abnormal status.

As described above, when a normal status bit value or an abnormal status bit value is continually recorded several times or more, the unit status check unit 210 may finally confirm the status of the corresponding status check unit 200 to be normal or abnormal, thereby preventing a misjudgment according to a temporary abnormality or a temporary normality, and preventing an erroneous countermeasure according to that.

The above-described controller 230 may perform an abnormality response process on the corresponding status check unit 200 step-by-step according to the number of times that an abnormal status bit value is continually recorded in the status register 220 of the corresponding status check unit 200.

For example, the controller 230 may perform a first step of the abnormality response process when an abnormal status bit value is first recorded in the status register 220, may perform a second step of the abnormality response process when the abnormal status bit value is continually recorded in the status register 220 more than two times and less than the number of times for confirming an abnormal status, and may perform a third step of the abnormality response process when the abnormal status bit value is continually recorded in the status register 220 more than the number of times for confirming an abnormal status.

Here, the first step of the abnormality response process may be, for example, a process of maintaining the operation of the corresponding status check unit 200 in a normal status without any countermeasure, or a process of stopping the operation of the corresponding status check unit 200. The second step of the abnormality response process may be, for example, a process of stopping the operation of the corresponding status check unit 200. The third step of the abnormality response process may be, for example, a process of blocking the power supply to the corresponding status check unit 200, the display device 100, or the display panel 110.

As described above, the number of times that an abnormal status bit value is continually recorded in the status register 220 of the corresponding status check unit 200 may be an indicator for identifying how long the abnormal status of the corresponding status check unit 200 is maintained, or how serious the abnormal status of the corresponding status check unit 200 is. Accordingly, the controller 230 may take a countermeasure adapted to the maintenance time or the degree of severity of the abnormal status of the corresponding status check unit 200, by performing the abnormality response process step-by-step on the corresponding status check unit 200 according to the number of times that the abnormal status bit value is continually recorded in the status register 220 of the corresponding status check unit 200.

Meanwhile, in cases where a normal status bit value is recorded after an abnormal status bit value is continually recorded in the status register 220 of the corresponding status check unit 200 more than one time and less than the number of times for confirming an abnormal status, the controller 230 may lower the step of the abnormality response process, and when the normal status bit value is continually recorded more than the number of times for confirming a normal status, the controller 230 may stop all the steps of the abnormality response process and may control the status check unit 200 to normally operate.

As described above, in cases where a status bit value is changed from an abnormal status bit value, which is continually recorded less than a predetermined number of times (the number of times for confirming an abnormal status), to a normal status bit value, the controller 230 may lower the step of the abnormality response process, and when the normal status bit value is continually recorded more than a predetermined number of times (the number of times for confirming a normal status), the controller 230 may stop the abnormality response process to restore the status check unit 200 so as to be normally operated, thereby preventing an unnecessary countermeasure for the temporarily abnormal status.

Figure 3:
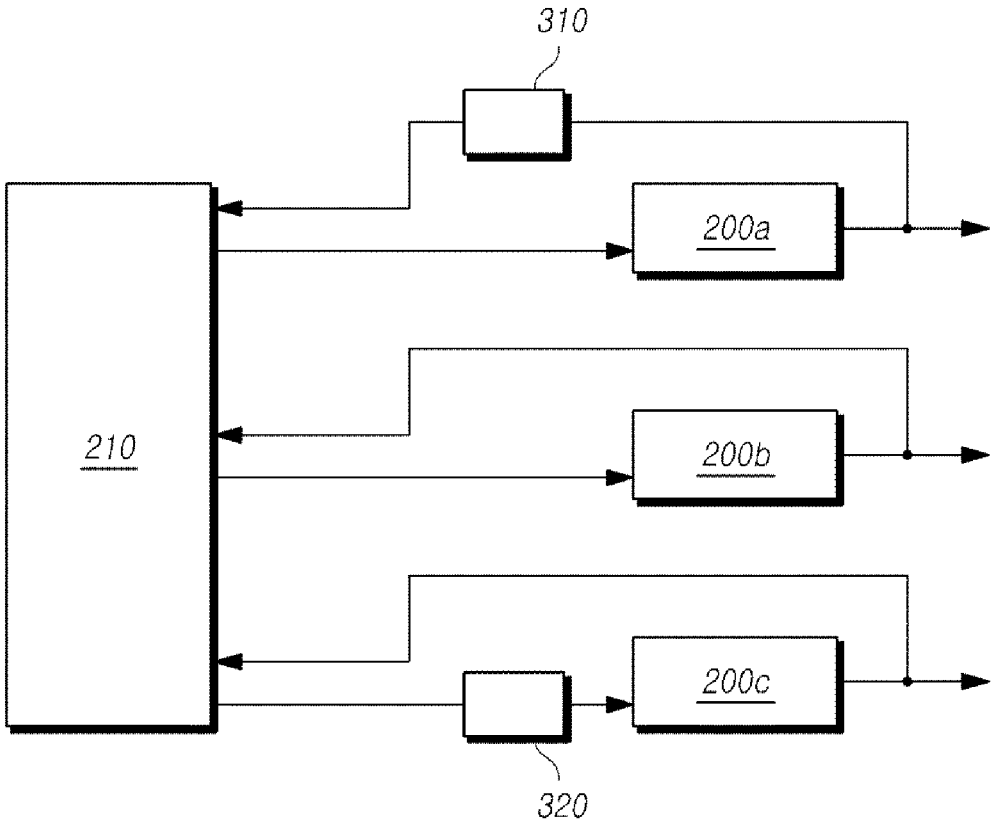
FIG. 3 is a view illustrating additional signal transmitting elements according to status check units in the display device according to the embodiments.

FIG. 3 is a view illustrating additional signal transmitting elements according status check units 200 in the display device 100 according to the embodiments.

Referring to FIG. 3, the respective status check units 200 may have different input and output formats according to their own functions.

Referring to FIG. 3, according to input/output formats, the status check units 200 may be classified into a first type of status check unit 200*b*, the input and output of which are all digital signals, a second type of status check unit 200*a*, the input of which is a digital signal and the output of which is an analog signal, and a third type of status check unit 200*c*, the input of which is an analog signal and the output of which is a digital signal.

Referring to FIG. 3, the input and output of the unit status check unit 210 that may be included in the timing controller 140 are all digital signals.

Therefore, according to the types of the status check units 200, an additional element that changes the type of a transferred signal so as to be recognizable is required for signal transmission between the unit status check unit 210 and the status check units 200.

Referring to FIG. 3, in cases where the status check unit 200 is a unit (e.g., a digital analog converter (DAC)) that outputs an analog signal, a first converter 310 that converts a feedback signal (analog signal) fed back from the status check unit 200 into a digital signal and inputs the converted digital signal to the unit status check unit 210 may be further included. Here, the analog digital converter (ADC) in the data driver IC 120 may be used as the first converter 310.

Referring to FIG. 3, in cases where the status check unit 200 is a unit (e.g., an analog digital converter (ADC)) that receives an input of an analog signal, a second converter 320 that converts a status check command signal (digital signal) output from the unit status check unit 210 into an analog signal and inputs the converted analog signal to the status check unit 200 may be further included. Here, the digital analog converter (DAC) in the data driver IC 120 may be used as the second converter 320.

The additional signal transmitting elements 310 and 320 described above make it possible to check the statuses of all types of status check units 200 irrespective of the input/output formats thereof.

Figure 4:
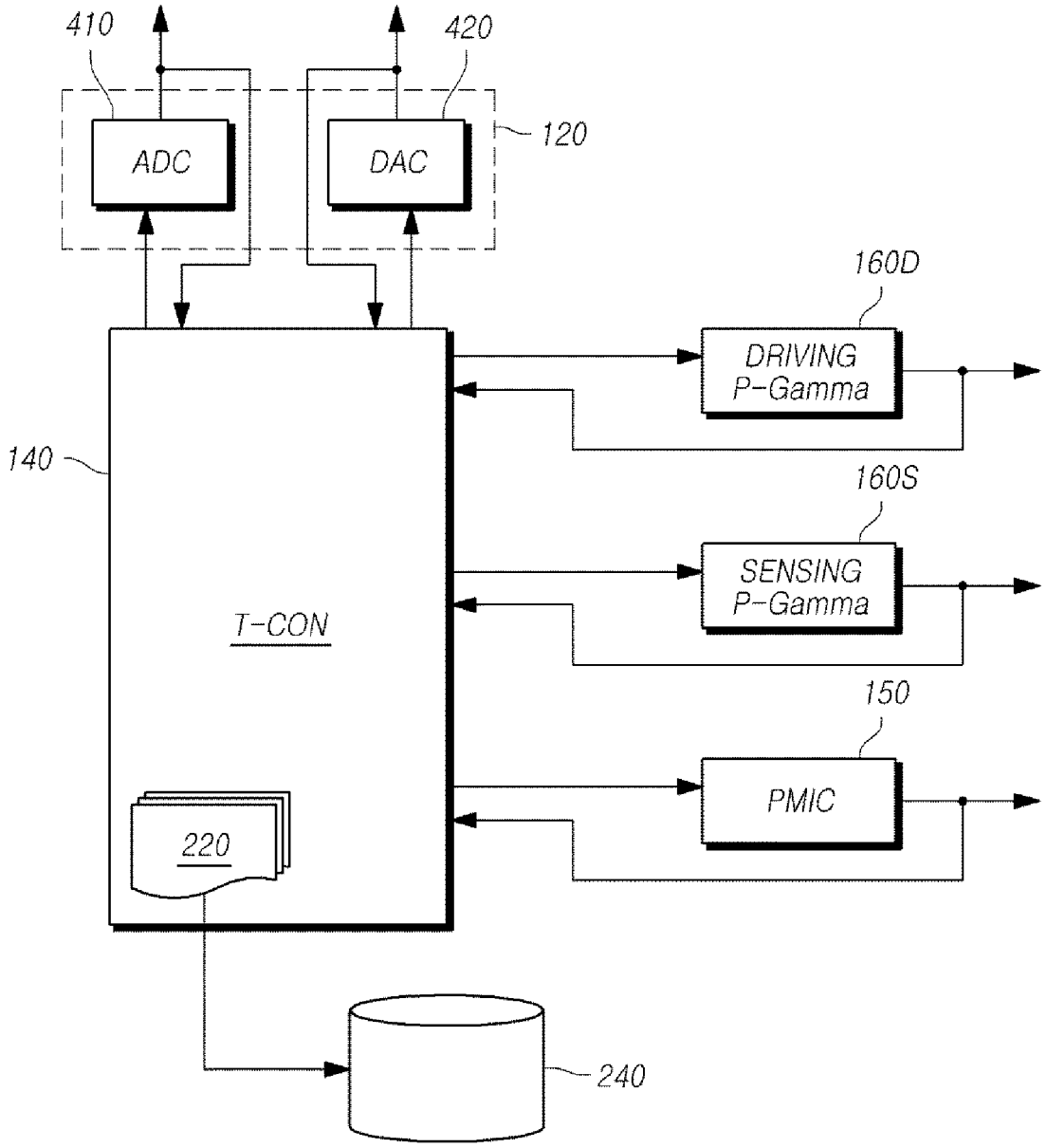
FIG. 4 is a view illustrating an example of a unit status check function of the display device according to the embodiments.

FIG. 4 is a view illustrating an example of a unit status check function of the display device 100 according to the embodiments.

FIG. 4 is a view for explaining a unit status check function in cases where display driving related units (status check units 200) of which the statuses have to be checked by the unit status check unit 210 are the power management integrated circuit (PMIC) 150, the gamma unit 160 that includes a driving programmable unit 160D and a sensing programmable gamma unit 160S, and an analog digital converter (ADC) 410 and a digital analog converter (DAC) 420 in the data driver integrated circuit 120.

Referring to FIG. 4, in cases where the status check unit 200 is the power management integrated circuit 150, the unit status check unit 210 that may be included in the timing controller (T-CON) 140 outputs an enable signal, which is a power output command signal, to the power management integrated circuit 150 as a status check command signal and receives a signal, as a feedback signal, which corresponds to the power that the power management integrated circuit 150 outputs to the display panel 110, the data driver integrated circuit 120, or the gate driver integrated circuit 130.

This may help to prevent an abnormal operation of the power management integrated circuit 150, to take a proper countermeasure when the abnormal operation of the power management integrated circuit 150 happens, and to prevent a failure in driving or damage which may happen in the display panel 110, the data driver integrated circuit 120, or the gate driver integrated circuit 130, thereby preventing screen abnormality.

Referring to FIG. 4, in cases where the status check unit 200 is the driving programmable gamma unit 160D, the unit status check unit 210 which may be included in the timing controller 140 outputs a driving programmable gamma setting value, as a status check command signal, to the driving programmable gamma unit 160D and receives a signal, as a feedback signal, which corresponds to a driving programmable gamma output value that the driving programmable gamma unit 160D outputs. Here, the driving programmable gamma setting value may be stored in a register 220 of the timing controller 140, and the driving programmable gamma unit 160D which operates in a driving mode may create linear gamma according to an input value.

This may help to prevent an abnormal operation of the driving programmable gamma unit 160D, to take a proper countermeasure when the abnormal operation of the driving programmable gamma unit 160D happens, and to prevent screen abnormality that may happen according to the abnormal operation of the driving programmable gamma unit 160D.

Referring to FIG. 4, in cases where the status check unit 200 is the sensing programmable gamma unit 160S, the unit status check unit 210 which may be included in the timing controller 140 outputs a sensing programmable gamma setting value, as a status check command signal, to the sensing programmable gamma unit 160S and receives a signal, as a feedback signal, which corresponds to a sensing programmable gamma output value that the sensing programmable gamma unit 160S outputs. Here, the sensing programmable gamma setting value may be stored in a register 220 of the timing controller 140, and the sensing programmable gamma unit 160S which operates in a sensing mode may create linear gamma according to an input value.

This may help to prevent an abnormal operation of the sensing programmable gamma unit 160S, to take a proper countermeasure when the abnormal operation of the sensing programmable gamma unit 160S happens, and to prevent a screen abnormality that may happen according to the abnormal operation of the sensing programmable gamma unit 160S.

Referring to FIG. 4, in cases where the status check unit 200 is the analog digital converter 410 in the data driver integrated circuit 120, the unit status check unit 210 which may be included in the timing controller 140 outputs an analog voltage value, as a status check command signal, to the analog digital converter 410 and receives a signal, as a feedback signal, which corresponds to a digital value that the analog digital converter 410 outputs.

This may help to prevent an abnormal operation of the analog digital converter 410, to take a proper countermeasure when the abnormal operation of the analog digital converter 410 happens, and to prevent an error of sensing data that may happen according to the abnormal operation of the analog digital converter 410 and a false data compensation using the erroneous sensing data, thereby preventing screen abnormality.

Referring to FIG. 4, in cases where the status check unit 200 is the digital analog converter 420 in the data driver integrated circuit 120, the unit status check unit 210 which may be included in the timing controller 140 outputs a digital voltage value, as a status check command signal, to the digital analog converter 420 and receives a signal, as a feedback signal, which corresponds to an analog voltage value that the digital analog converter 420 outputs.

This may help to prevent an abnormal operation of the digital analog converter 420, to take a proper countermeasure when the abnormal operation of the digital analog converter 420 happens, and to prevent a screen abnormality according to abnormality in image expression that may happen according to the abnormal operation of the digital analog converter 420.

Figure 5:
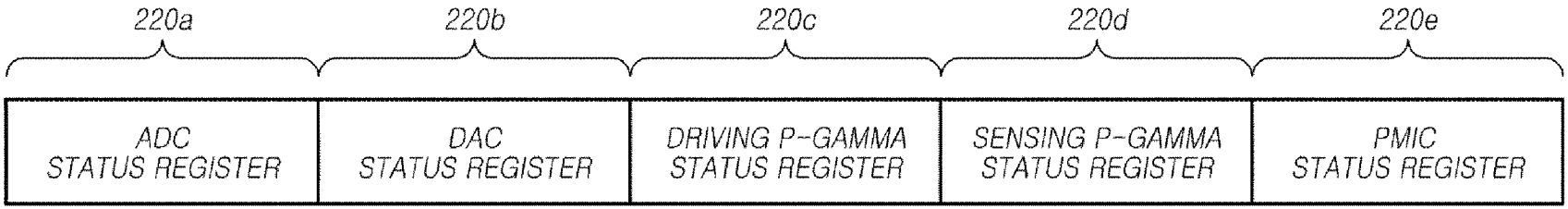
FIG. 5 is a view illustrating an example of a status register in which status bit values are recorded according to status check units in the display device according to the embodiments.

FIG. 5 is a view illustrating an example of the status register 220 in which status bit values are recorded according to the status check units 200 in the display device 100 according to the embodiments.

FIG. 5 is a view illustrating status registers 220*a*, 220*b*, 220*c*, 220*d*, and 220*e* for the status check units 200 included in the timing controller 140 in cases where display driving related units, namely, the status check units 200 of which the statuses have to be checked by the unit status check unit 210 are the power management integrated circuit 150, the driving programmable unit 160D, the sensing programmable gamma unit 160S, the analog digital converter 410, and the digital analog converter 420 as illustrated in FIG. 4.

Figure 6:
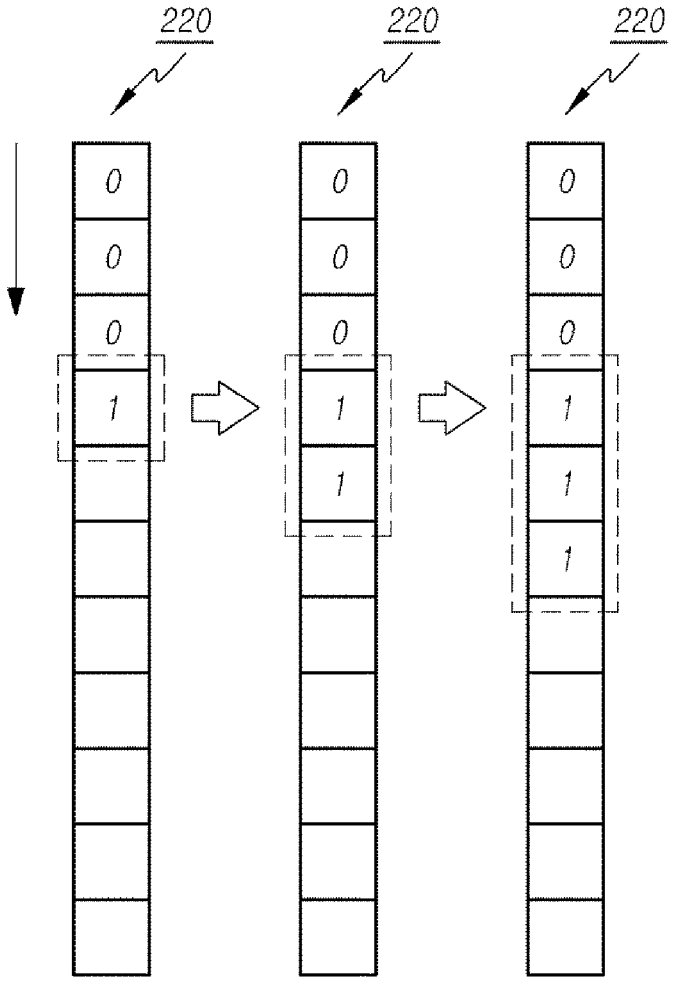
FIG. 6 is a view illustrating an example in which a status bit value is recorded in the status register according to a status check result in the display device according to the embodiments.

FIG. 6 is a view illustrating an example in which a status bit value is recorded in the status register 220 according to status check result in the display device 100 according to the embodiments.

FIG. 6 illustrates an example of sequentially recording status bit values in the status register 220 of the corresponding status check unit 200 according to the fourth to sixth status check results when the unit status check unit 210 performs the status check on the status check unit 200 six times. However, it is assumed that a normal status bit value is "0", an abnormal status bit value is "1", the number of times for confirming an abnormal status is "3", and the number of times for confirming a normal status is "3".

Referring to the leftmost status register 220 of FIG. 6, in a state where "0" corresponding to a normal state bit value is recorded in the status register 220 according to the first to third status check results showing that the status check unit 200 is in a normal state, the unit status check unit 210 performs the fourth status check to determine that the status check unit 200 is in an abnormal status, and records "1" corresponding to the abnormal status bit value in the status register 220.

In this case, the controller 230 may perform the first step of an abnormality response process since the abnormal status bit value is first recorded.

Referring to the status register 220 in the center of FIG. 6, the unit status check unit 210 performs the fifth status check to determine that the status check unit 200 is in the abnormal status, and additionally records "1" corresponding to the abnormal status bit value in the status register 220.

In this case, the controller 230 may perform the second step of the abnormality response process since the abnormal status bit value is continually recorded two times.

Referring to the rightmost status register 220 of FIG. 6, the unit status check unit 210 performs the sixth status check to determine that the status check unit 200 is in the abnormal status, and additionally records "1" corresponding to the abnormal status bit value in the status register 220.

In this case, the controller 230 may perform the third step of the abnormality response process since the abnormal status bit value is continually recorded three times that corresponds to the number of times for confirming the abnormal status.

Figure 7:
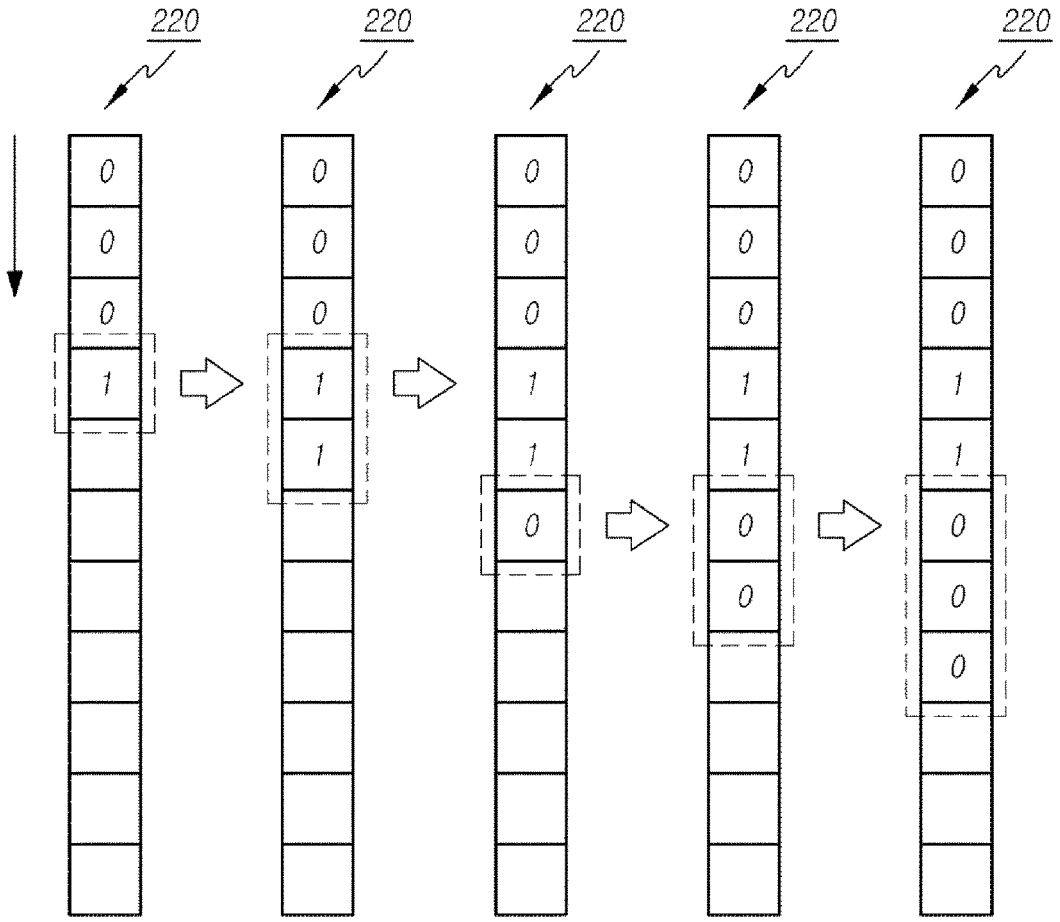
FIG. 7 is a view illustrating another example in which a status bit value is recorded in the status register according to a status check result in the display device according to the embodiments.

FIG. 7 is a view illustrating another example in which a status bit value is recorded in the status register 220 according to a status check result in the display device 100 according to the embodiments.

FIG. 7 is a view illustrating an example of sequentially recording status bit values in the status register 220 of the corresponding status check unit 200 according to the fourth to eighth status check results when the unit status check unit 210 performs the status check on the status check unit 200 eight times. However, it is assumed that a normal status bit value is "0", an abnormal status bit value is "1", the number of times for confirming an abnormal status is "3", and the number of times for confirming a normal status is "3".

Referring to the first left status register 220 of FIG. 7, in a state where "0" corresponding to a normal state bit value is recorded in the status register 220 according to the first to third status check results showing that the status check unit 200 is in a normal state, the unit status check unit 210 performs the fourth status check to determine that the status check unit 200 is in an abnormal status, and records "1" corresponding to the abnormal status bit value in the status register 220.

In this case, the controller 230 may perform the first step of an abnormality response process since the abnormal status bit value is first recorded.

Referring to the second left status register 220 of FIG. 7, the unit status check unit 210 performs the fifth status check to determine that the status check unit 200 is in the abnormal status, and additionally records "1" corresponding to the abnormal status bit value in the status register 220.

In this case, the controller 230 may perform the second step of the abnormality response process since the abnormal status bit value is continually recorded two times.

Referring to the third left status register 220 of FIG. 7, the unit status check unit 210 performs the sixth status check to determine that the status check unit 200 is in a normal status, and additionally records "0" corresponding to the normal status bit value in the status register 220.

In this case, the controller 230 performs the first step of the abnormality response process instead of the second step of the abnormality response process since "0" corresponding to the normal status bit value is first recorded after "1" corresponding to the abnormal status bit value is continually recorded in the status register 220 two times which is less than the number of times (three times) needed to confirm an abnormal status.

Referring to the fourth left status register 220 of FIG. 7, the unit status check unit 210 performs the seventh status check to determine that the status check unit 200 is in the normal status, and additionally records "0" corresponding to the normal status bit value in the status register 220.

In this case, the controller 230 maintains the first step of the abnormality response process at it is since "0" corresponding to the normal status bit value is continually recorded two times which is less than the number of times (three times) needed to confirm a normal status. If there is a step lower than the first step, the controller 230 may perform the lower step.

Referring to the fifth left status register 220 of FIG. 7, the unit status check unit 210 performs the eighth status check to determine that the status check unit 200 is in the normal status, and additionally records "0" corresponding to the normal status bit value in the status register 220.

In this case, the controller 230 may stop all the steps of the abnormality response process and may control the corresponding status check unit 200 to normally operate since "0" corresponding to the normal status bit value is continually recorded three times which equals to the number of times (three times) needed to confirm a normal status.

FIG. 8 is a view illustrating yet another example in which a status bit value is recorded in the status register 220 according to a status check result in the display device 100 according to the embodiments.

FIG. 8 illustrates an example of checking the status of the driving programmable gamma unit 160D four times and recording a status bit value in the corresponding status register 220*c* in cases where the driving programmable gamma unit 160D is the status check unit 200. However, it is assumed that the number of channels is 8. Further, it is assumed that a normal status bit value is "0", an abnormal status bit value is "1", the number of times for confirming an abnormal status is "3", and the number of times for confirming a normal status is "3".

Referring to the first status register 220*c* of FIG. 8, based on status check results of eight channels (CH1, . . . , CH8), "1" which is the abnormal status bit value is recorded only for the channel CH8 that is determined to be in an abnormal status, and "0" which is the normal status bit value is recorded for the remaining channels CH1 to CH7 that are determined to be in a normal status.

Referring to the second status register 220*c* of FIG. 8, based on status check results of eight channels (CH1, . . . , CH8), "1" which is the abnormal status bit value is recorded for the channels CH1 and CH5 that are determined to be in an abnormal status, and "0" which is the normal status bit value is recorded for the remaining channels CH2, CH3, CH4, CH6, CH7, and CH8 that are determined to be in a normal status.

Referring to the third status register 220*c* of FIG. 8, based on status check results of eight channels (CH1, . . . , CH8), "1" which is the abnormal status bit value is recorded for the channels CH1 and CH5 that are determined to be in an abnormal status, and "0" which is the normal status bit value is recorded for the remaining channels CH2, CH3, CH4, CH6, CH7, and CH8 that are determined to be in a normal status.

Referring to the fourth status register 220*c* of FIG. 8, based on status check results of eight channels (CH1, . . . , CH8), "1" which is the abnormal status bit value is recorded for the channels CH1 and CH5 that are determined to be in an abnormal status, and "0" which is the normal status bit value is recorded for the remaining channels CH2, CH3, CH4, CH6, CH7, and CH8 that are determined to be in a normal status.

The variation of the status register 220*c* illustrated in FIG. 8 shows that the abnormal status bit value is continually recorded as many times as the number of times (three times) for confirming an abnormal status.

Accordingly, the controller may stop the operation of the driving programmable gamma unit 160D, or may turn off power.

Further, the variation of the status register 220*c* illustrated in FIG. 8 shows that in the case of the channel CH8, the abnormal status bit value is recorded once, and thereafter the normal status bit value is continually recorded three times which is equal to the number of times needed to confirm a normal status. This may help to identify that the temporary abnormality has happened for a short time for the channel CH8.

The embodiments of the present invention described above may provide the display device 100 and the timing controller 140 which can check the status of a display driving related unit.

Further, according to the embodiments of the present invention, a proper countermeasure can be taken according to the status of a display driving related unit, thereby preventing an abnormal operation of the unit, or thereby preventing a failure in driving, damage to a device, and screen abnormality that may happen according to the abnormal operation of the unit.

The above description and the accompanying drawings provide an example of the technical idea of the present invention for illustrative purposes only. Those having ordinary knowledge in the technical field, to which the present invention pertains, will appreciate that various modifications and changes in form, such as combination, separation, substitution, and change of a configuration, are possible without departing from the essential features of the present invention. Therefore, the embodiments disclosed in the present invention are intended to illustrate the scope of the technical idea of the present invention, and the scope of the present invention is not limited by the embodiment. The scope of the present invention shall be construed on the basis of the accompanying claims in such a manner that all of the technical ideas included within the scope equivalent to the claims belong to the present invention.

What is claimed is:

1. A display device comprising:

a unit status check unit that outputs a status check command signal to a status check unit corresponding to a display driving related unit, receives a signal output from the status check unit as a feedback signal according to the status check command signal, and records a status bit value of the status check unit in a status register corresponding to the status check unit based on the feedback signal;

a memory that stores the status bit value of the status register corresponding to the status check unit; and a controller that performs an abnormality response process step-by-step according to the number of times that the abnormal status bit value is continually recorded in the status register, wherein the controller performs a first step of the abnormality response process when the abnormal status bit value is first recorded in the status register, performs a second step of the abnormality response process when the abnormal status bit value is continually recorded in the status register more than two times and less than the number of times needed to confirm an abnormal status, and performs a third step of the abnormality response process when the abnormal status bit value is continually recorded in the status register more than the number of times needed to confirm an abnormal status, wherein the display driving related unit is one of a data driver integrated circuit, a gate driver integrated circuit, a power management integrated circuit and a gamma unit.

2. The display device of claim 1, wherein the unit status check unit determines whether an actual output value identified from the feedback signal falls within a predetermined normal output range, determines that the status check unit is in a normal status and records a normal status bit value in the status register when it is determined that the actual output value falls within the predetermined normal output range, and determines that the status check unit is in an abnormal status and records an abnormal status bit value in the status register when it is determined that the actual output value departs from the predetermined normal output range.

3. The display device of claim 2, wherein the unit status check unit finally confirms the normal status of the status check unit when the normal status bit value is continually recorded in the status register more than the number of times needed to confirm a normal status, and finally confirms the abnormal status of the status check unit when the abnormal status bit value is continually recorded in the status register more than the number of times needed to confirm an abnormal status.

4. The display device of claim 3, wherein the controller that controls the status check unit, the display device, or power according to the status bit value recorded in the status register.

5. The display device of claim 1, wherein the controller lowers the step of the abnormality response process when the normal status bit value is recorded after the abnormal status bit value is continually recorded in the status register more than one time and less than the number of times needed to confirm an abnormal status, and the controller stops all the steps of the abnormality response process and controls the status check unit to normally operate when the normal status bit value is continually recorded more than the number of times for confirming a normal status.

6. The display device of claim 1, further comprising:

a first converter that converts the feedback signal fed back from the status check unit into a digital signal and inputs the converted digital signal to the unit status check unit when the status check unit is a unit that outputs an analog signal.

7. The display device of claim 1, further comprising:

a second converter that converts the status check command signal output from the unit status check unit into an analog signal and inputs the converted analog signal to the status check unit when the status check unit is a unit that receives an input of an analog signal.

8. The display device of claim 1, wherein when the status check unit is a power management integrated circuit, the unit status check unit outputs an enable signal to the power management integrated circuit as the status check command signal, and receives a signal, as a feedback signal, which corresponds to the power that the power management integrated circuit outputs to a display panel, a data driver integrated circuit, or a gate driver integrated circuit.

9. The display device of claim 1, wherein when the status check unit is a driving programmable gamma unit, the unit status check unit outputs a driving programmable gamma setting value to the driving programmable gamma unit as the status check command signal, and receives a signal, as the feedback signal, which corresponds to a driving programmable gamma output value that the driving programmable gamma unit outputs.

10. The display device of claim 1, wherein when the status check unit is a sensing programmable gamma unit, the unit status check unit outputs a sensing programmable gamma setting value to the sensing programmable gamma unit as the status check command signal, and receives a signal, as the feedback signal, which corresponds to a sensing programmable gamma output value that the sensing programmable gamma unit outputs.

11. The display device of claim 1, wherein when the status check unit is an analog digital converter in a data driver integrated circuit, the unit status check unit outputs an analog voltage value to the analog digital converter as the status check command signal, and receives a signal, as the feedback signal, which corresponds to a digital value that the analog digital converter outputs.

12. The display device of claim 1, wherein when the status check unit is a digital analog converter in a data driver integrated circuit, the unit status check unit outputs a digital value to the digital analog converter as the status check command signal, and receives a signal, as the feedback signal, which corresponds to an analog voltage value that the digital analog converter outputs.

13. A timing controller comprising:

a status register that corresponds to each of a plurality of status check units relevant to display driving related units;

a unit status check unit that outputs a status check command signal to each of the plurality of status check units, receives a signal output from the corresponding status check unit as a feedback signal according to the status check command signal, and records a status bit value of the corresponding status check unit in a status register corresponding to the corresponding status check unit based on the feedback signal; and a controller that performs an abnormality response process step-by-step according to the number of times that the abnormal status bit value is continually recorded in the status register, wherein the controller performs a first step of the abnormality response process when the abnormal status bit value is first recorded in the status register, performs a second step of the abnormality response process when the abnormal status bit value is continually recorded in the status register more than two times and less than the number of times needed to confirm an abnormal status, and performs a third step of the abnormality response process when the abnormal status bit value is continually recorded in the status register more than the number of times needed to confirm an abnormal status, wherein the display driving related unit is one of a data driver integrated circuit, a gate driver integrated circuit, a power management integrated circuit and a gamma unit.

14. The timing controller of claim 13, further comprising:

a controller that controls the status check unit, a display device, or power according to the status bit value recorded in the status register.

15. A display device comprising:

a timing controller that determines the status of a display driving related unit based on an output signal of the display driving related unit and records a status bit value in a status register corresponding to the display driving related unit;

a memory that stores the status register corresponding to the display driving related unit; and a controller that performs an abnormality response process step-by-step according to the number of times that the abnormal status bit value is continually recorded in the status register, wherein the controller performs a first step of the abnormality response process when the abnormal status bit value is first recorded in the status register, performs a second step of the abnormality response process when the abnormal status bit value is continually recorded in the status register more than two times and less than the number of times needed to confirm an abnormal status, and performs a third step of the abnormality response process when the abnormal status bit value is continually recorded in the status register more than the number of times needed to confirm an abnormal status, wherein the display driving related unit is one of a data driver integrated circuit, a gate driver integrated circuit, a power management integrated circuit and a gamma unit.

* * * * *